United States Patent [19]

Gilmore et al.

[11] Patent Number: 4,824,559

[45] Date of Patent: Apr. 25, 1989

[54] ROTARY AIR SEPARATOR

[76] Inventors: Larry J. Gilmore, 17555 S.E., Braden, Oreg. 97027; John W. Makin, 12405 S.E. 27th St., Milwaukie, Oreg. 97222

[21] Appl. No.: 54,442

[22] Filed: May 27, 1987

[51] Int. Cl.[4] ..... B07B 13/00

[52] U.S. Cl. ..... 209/23; 209/45

[58] Field of Search ..... 209/44.1–44.3, 209/23, 22, 45, 46, 133, 643, 250, 295

[56] References Cited

U.S. PATENT DOCUMENTS

| | | | |
|---|---|---|---|
| 2,928,542 | 3/1960 | Mencimer | 209/45 |
| 3,397,778 | 8/1968 | Karlsson | 209/23 |
| 3,587,851 | 6/1971 | Anderson | 209/643 |
| 4,165,278 | 8/1979 | Jaffey | 209/45 |
| 4,515,276 | 5/1985 | Feller et al. | 209/44.2 |

FOREIGN PATENT DOCUMENTS

| | | | |
|---|---|---|---|
| 878149 | 4/1953 | Fed. Rep. of Germany | 209/133 |
| 244765 | 5/1969 | U.S.S.R. | 209/45 |

*Primary Examiner*—Robert B. Reeves
*Assistant Examiner*—Donald T. Hajec

[57] ABSTRACT

A rotary air separator having a manifold with a side opening and an end opening. A cylindrical screen rotates around the manifold over the side opening and the end opening is connected to a vacuum source. Vanes in the manifold segregate the side opening into discrete areas. The vanes define independent throats for directing air in a curved transitional path from the side opening areas to the end opening. A collar surrounding the side opening defines a curved inlet to the side opening and provides an effective air barrier to inhibit air flow from around the manifold.

5 Claims, 1 Drawing Sheet

ROTARY AIR SEPARATOR

FIELD OF INVENTION

This invention relates to an apparatus utilizing air flow for separating different sizes and masses of material, and more particularly to features that smoothen the air flow to make the apparatus more efficient in its operation.

BACKGROUND OF THE INVENTION

Rotary air separators are known as disclosed in U.S. patent application Ser. No. 841,168. In general the apparatus comprises a manifold having an opening through which air is drawn. The manifold is surrounded by a cylindrically shaped screen that rotates past the opening. A mixture of materials, e.g. sawdust, bark, and gravel, is deposited on the screen in the area of the manifold opening. The air flow through the screen and into the manifold has different effects on different materials of the mixture of materials. The fine material (e.g. saw dust), is drawn through the screen (as permitted by the size of the screen openings), and carried by the air flow to a first collection station. The larger-than-screen-size bark is drawn to the screen and carried by the screen past the manifold opening (generally located near the top of the apparatus) to the opposite side of the separator where it is collected at a second collection station. The air flow is established to discriminately draw and hold the lesser mass of the bark. The mass of the gravel is such that it falls from the screen at the infeed side of the apparatus and is collected at a third station.

The problem to which the present invention is directed relates to the air flow. In order to accomplish the separation of the materials, a substantial volume of air is drawn through the manifold. Considering that the overall shape of the apparatus is similar to that of a drum, the air flow is drawn laterally through an opening in the side of the drum, and then redirected axially out the end of the drum. In prior apparatus, as the air is first drawn through the screen and into the manifold opening, distruptive eddy currents are generated. As the air is redirected around corners; i.e., from the side opening to the end, further disruptive eddy currents are generated. These eddy currents significantly negatively effect the system's efficiency.

A further problem with prior rotary air separators is the failure of such devices to generate a consistent air flow across the area of the manifold opening. With one portion of the area of the opening receiving a greater flow of air than another, separation will not be consistent.

BRIEF DESCRIPTION OF THE INVENTION

The above problems with prior apparatus is alleviated by the provision of curved air vanes within the manifold. The path of the air flow from the side opening to the end opening is viewed as a conduit. The conduit is sectioned into multiple sub-conduits by curved vanes that are fit to the interior of the manifold. The vanes, in cooperation with the interior walls of the manifold, are formed so as to avoid any sharp corners that might create the distruptive eddy currents.

The air inlet opening in the side of the manifold is thus segregated, e.g. into four or more areas, with each area in effect provided with its own air source; i.e., each is exposed independently of other conduits or air throats to the air vacuum source. Each of the areas thus has the same air suction and as between sections, the action of material separation is the same.

A rounded collar is provided around the air inlet opening so that as air is drawn to the opening; i.e., as it engages the edge that defines the air opening, the edge is provided with a curved incoming surface to enhance a smooth transition of the air flow from the atmosphere into the confined area defined by the opening.

The above features will be further understood and appreciated by reference to the following detail description and drawings wherein.

Figure 1:
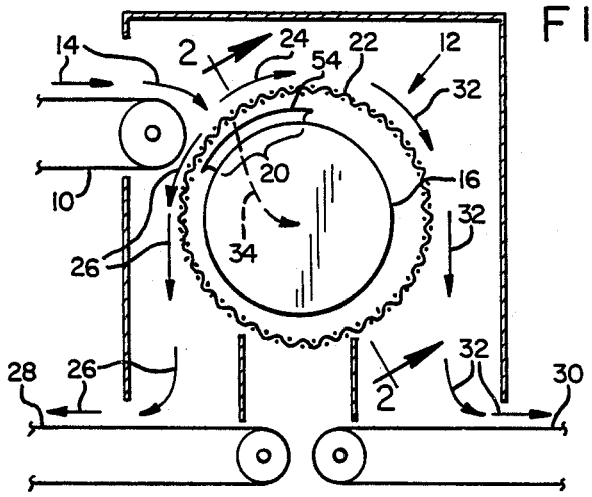
FIG. 1 is a schematic illustration of a rotary air separator in accordance with the present invention.

Referring now to the illustration of FIG. 1, a mixture of materials is conveyed by conveyor 10 to the rotary air separator 12 as indicated by arrows 14. The rotary air separator in general includes a manifold 16 that is enclosed except for its end connection to an air vacuum source 18 (FIG. 2) and a side opening 20. A cylindrically shaped screen 22 is mounted for rotation (arrow 24) about the manifold 16.

In operation, the mixture of material (14) is deposited on the screen just as the screen is crossing over the opening 20. The mixture includes gravel or small rock that is heavy. Gravity is a greter force than the air suction applied to the rock and the rock material simply falls from the conveyer as indicated by arrows 26. It falls onto a second conveyor 28 where it is conveyed to a collection station.

The mixture (14) includes bark chips and similar materials that are lighter than the rock and are thus drawn to opening 20. Because the screen openings are smaller than the bark and wood chip dimensions, this material is held against the screen 22 as the screen is rotated over the top of the apparatus. After it crosses over the top i.e. the uppermost position of the screen, and away from the opening, the air suction is cut off and the material is released from the screen and dropped onto a third conveyor 30 as indicated by arrows 32.

A third component of the mixture is bark dust, dirt, and other fine materials that is drawn through the screen (see arrows 34) to the vacuum source where it is intercepted and collected.

Figure 5:
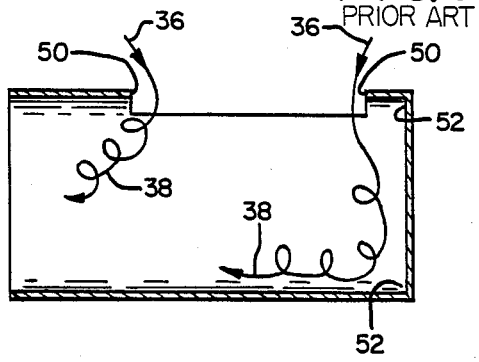
FIG. 5 PRIOR ART
FIG. 5 is a schematic illustration of how air flow eddy currents are generated in prior apparatus.

The above generally described components and the operation thereof is not unique to this invention. They are disclosed in the commonly assigned application of Larry Gilmore, Ser. No. 841,168, entitled "Debris Separator System". The problem with the prior apparatus is schematically illustrated in FIG. 5. The control of air flow into and through the system is of great importance to the satisfactory operation. If certain portions of areas of the larger area of opening 20 have different flow of air than other portions, the system will not work properly. The air flow is controlled (when working properly) so that materials only of a certain density will be drawn to the screen. If that air flow is not consistent across the area of the opening, then such control is not available. Note from FIG. 5 that the high rate of air flow 36 around edges 50 and corners 52 sets up eddy currents (indicated at 38) that significantly effect the efficiency of the system and generate inconsistencies in air flow into and through the system. The present invention provides features that obviate these undesirable characteristics of air flow into and through the system and will be now described.

Figure 2:
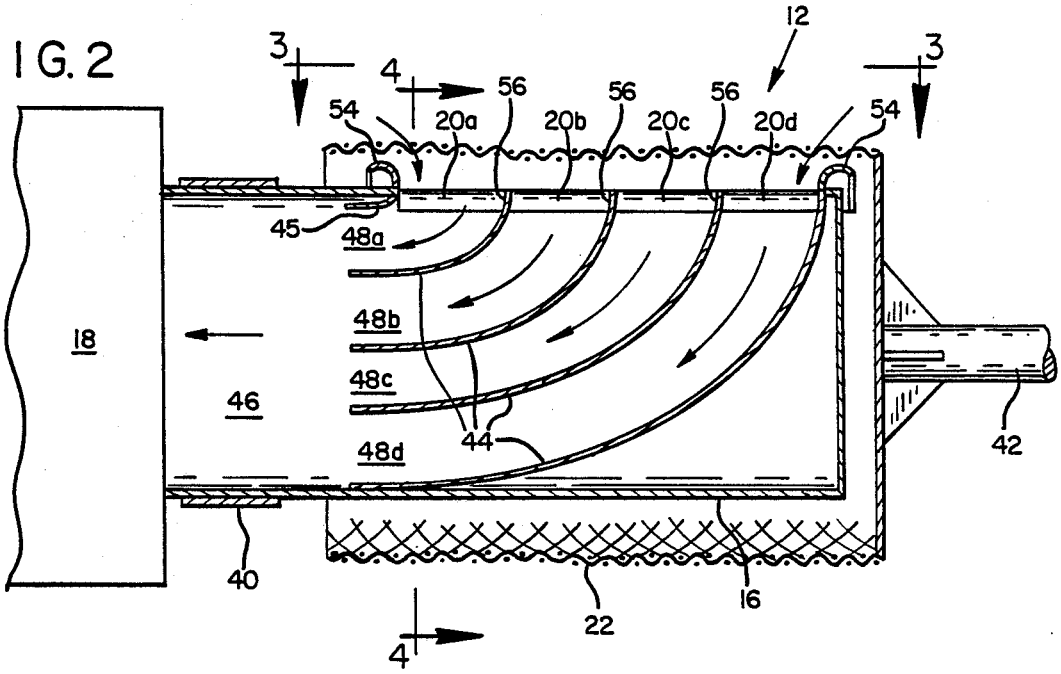
FIG. 2 is a section view of the apparatus taken on section line 2—2 of FIG. 1.
Figure 3:
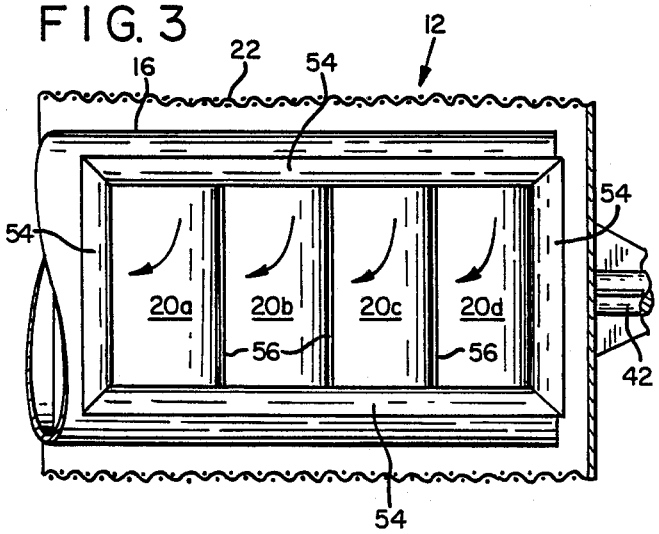
FIG. 3 is a section view of the apparatus taken on section line 3—3 of FIG. 2.
Figure 4:
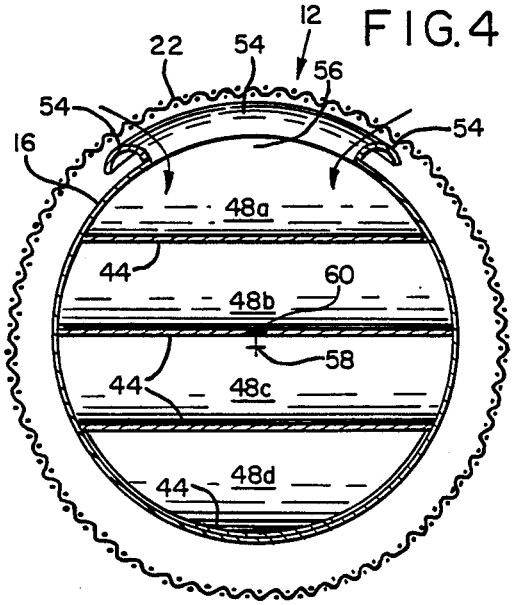
FIG. 4 is a section view of the apparatus taken on section line 4—4 of FIG. 2.

Reference is made to FIGS. 2 through 4 (but noting that FIG. 2 is a section view of FIG. 1). From FIG. 2, the manifold 16 is stationary in operation. However, the manifold can be angularly shifted so as to reposition the opening 20 at varying angular positions. A circular band 40 around the manifold is accessible to an operator in a case where the repositioning of the opening 20 is desirable. It may also be desirable to change the position of the infeed conveyor 10. These adjustments are not shown in detail as they do not constitute a contribution of the present invention. It is only necessary that the reader understand that the positions of these two components are adjustable but fixed during normal operation. The manifold 16 is opened at its end (the left end as viewed in FIG. 2) to the vacuum source 18 which typically houses a air suction fan (not shown).

Referring again to FIG. 2, the cylindrical screen 22 surrounds the manifold and is mounted for continuous rotation as generated by shaft 42 from a motor (not shown). The dimensions of the screen openings in screen 22 are provided to allow passage of "fines" as that term is determined for the desired separation. In the same manner, the suction of air through the opening 20, the speed of rotation of screen 22, and the angular location of the opening 20, are all coordinated whereby the desired lighter/larger materials are drawn to the screen and carried past the opening 20, while the heavier materials are gravity controlled and fall off the end of the conveyor 10 as indicated by arrows 26.

As explained previously, the problem in developing the desired relationship for this materials separation process in prior apparatus, occurs because there is not a consistent air flow through the broad area of opening 20. Eddy currents of air are created that are believed to contribute to the cause of this inconsistency. The present invention reduces or eliminates the eddy currents by the provision of means for creating a smooth transition of air drawn into and through opening 20 and then through the manifold and to the end opening into the suction fan.

Of greatest consequence is the provision of air vanes 44. These air vanes are thin metal dividers that divide the opening 20 into discrete, similarly sized areas 20*a*, 20*b*, 20*c*, and 20*d* which generate similar air flows within the individual areas and thereby a substantially consistent air flow across the side opening 20. Vanes 44 extend from the opening 20 through the manifold and to the end 46, at which point they terminate as shown. The vanes are curved to provide a smooth path for the air flow. It will be noted that the two inner vanes provide two smooth surfaces, one of concave curve for the air flow of one air throat and a convex curved surface for air flow of the other air throat.

Each vane 44 extends fully across the manifold with the sides of the vane conforming to the configuration of the manifold. This will be particularly appreciated by reference to FIGS. 3 and 4 where it will be noted that there are no gaps as between the sides of the vanes 44 and the inside surface of the manifold (the manifold being illustrated as circular or cylindrical in cross-section). In other words, the vanes 44 extend from the side opening 20 of the manifold, where the ends of the vanes are aligned axially relative to the screen 22, to the end opening of the manifold, where the ends of the vanes are aligned radially relative to the screen 22. Thus the vanes can be considered to divide the interior of the manifold into four compartments or throats 48*a*, 48*b*, 48*c*, and 48*d* that lead from end 46 in a smoothly curved transition to each of the areas 20*a*, 20*b*, 20*c*, and 20*d* of opening 20. The throats 48*a*, 48*b*, 48*c*, and 48*d* are configured (in conjunction with areas 20*a*, 20*b*, 20*c*, and 20*d*) so as to control the air flow from each area. Thus the common source of air suction (18) creates a vacuum in end 46 that draws a similar volume of air from each of the air throats 48*a* through 48*d*.

The vanes 44 accomplish two desirable effects. Air flow through the manifold is smoothly directed so as to avoid disruptive eddy currents. Furthermore, the segregated areas 20*a* through 20*d* are provided with equivalent air flow so that materials deposited in the area of 20*a* will be effected similar to that which is deposited on each of the areas 20*b*, 20*c*, and 20*d*. By adjusting the relationships of; air flow to the screen rpm's, and to the location of area 20, and to the location of conveyor 10, each of the areas 20*a* through 20*d* achieve overall consistent separation across opening 20.

A second feature of the invention deals with entry of air into the opening. Any restriction in the path of air flow can cause the distruptive eddy currents. As seen in FIG. 5, such restrictions include the edge openings 50 and the inside corners 52 of the illustrated prior manifold. The inside corners 52 have been eliminated by the vanes 44. The second feature of the invention includes the rolled collar 54 that outlines the opening 20. This collar provides a radius or convex curvature that functions like a funnel to gather air from the surrounding atmosphere into the restriction of opening 20. The amount of curvature is dictated largely by the overall specifications of the apparatus.

In an emobodiment designed and constructed in accordance with the invention, the spacing between the manifold opening 20 and the rotating screen 22 was just over one inch, and the collar was about one inch in diameter or just short of contact with the rotary screen. As will be viewed in FIG. 4, this spacing however can be minimally adjusted by adjustment of the center of rotation of the screen (point 58 in FIG. 4) relative to the manifold, e.g. its axis 60. The radius of the collar was about one-half inch and it was found that this indeed provided substantial benefit through the reduction of the distruptive eddy currents. The collar provides the secondary effect as a seal or barrier whereby the air flow is directed through the screen in the vicinity of the opening 20 as opposed to drawing air from around the manifold between the manifold and screen.

As a further improvement to the air flow into the compartments or throats 48*a* through 48*d*, the exposed edges 56 are thin or even sharpened. As an alternative and to further avoid air turbulence in throat 48*a*, a small vane 45 (shown in FIG. 2 only) may be added to further enhance air flow.

The benefits of the present invention will be readily recognized by those skilled in the art. Various alternatives and modifications to the above described preferred embodiment may be beneficially applied to rotary air separators without departing from the scope of the invention. For example, certain applications will require separation by mass only e.g. gravel vs bark, with fines not being a part of the mixture. Another application will require separation by size only e.g. fines vs bark. The invention is thus to be considered as that broadly defined in the claims appended hereto.

We claim:

1. A rotary air separator for separating a mixture of materials comprising; a configured manifold having an end opening and side opening, a vacuum air source connected to the end opening with the air flow through said end opening being substantially consistent throughout the included cross sectional area of said end opening, said vacuum air source drawing air from the side opening and through the manifold to the end opening, a cylindrical screen surrounding the manifold and being rotatably mounted for rotating the screen around a horizontal axis and across the side opening whereby air flow is directed radially through the screen, passes through an area of transition in the manifold to be directed through the end opening axially of the screen, and means for depositing the mixture of materials onto the screen as it crosses the side opening, and the improvement that comprises;

a plurality of vanes arranged in the manifold and cooperating with the manifold configuration to define a plurality of separated air directing throats throughout the area of transition, said plurality of vanes extended from the side opening where the ends of the vanes are aligned axially and thereby crossway to the air flow, to the end opening where the ends of the vanes are aligned radially and thereby crossway to the air flow, said vanes dividing the side opening into a plurality of area portions, and said throats and area portions cooperatively formed to generate similar air flow within the individual area portions and thereby a substantially consistent air flow across the side opening.

2. A rotary air separator as defined in claim 1 wherein the angular location of the side opening is located in an area of the path of the rotating screen extending from a point prior to the uppermost position of the screen to at least the uppermost position of the screen.

3. A rotary air separator for separating a mixture of materials comprising; a configured manifold having an end opening and side opening, a vacuum air source connected to the end opening with the air flow through said end opening being substantially consistent throughout the included cross sectional area of said end opening, said vacuum air source drawing air from the side opening and through the manifold to the end opening, a cylindrical screen surrounding the manifold and being rotatably mounted for rotating the screen around a horizontal axis and across the side opening whereby air flow is directed radially through the screen, passes through an area of transition in the manifold to be directed through the end opening axially of the screen, and means for depositing the mixture onto the screen as it crosses the side opening, and the improvement that comprises;

a plurality of vanes arranged in the manifold and cooperating with the manifold configuration to define a plurality of separated air directing throats, said plurality of vanes extended from the side opening where the ends of the vanes are aligned axially and thereby crossway to the air flow, to the end opening where the ends of the vanes are aligned radially and thereby crossway to the air flow, said vanes dividing the side opening into a plurality of area portions, said vanes and cooperating portions of the manifold configuration defining smoothly curved transition conduits for the air flow from the individual area portions of the side opening to the end opening, and further including a collar protruding from the edge outline of the side opening, said collar having a curved portion defining an inlet for air from the atmosphere into and through the side opening.

4. A rotary air separator as defined in claim 3 wherein the collar protrudes to a point just short of contact with the rotating screen to provide an effective barrier to inhibit air flow to the side opening from the space surrounding the manifold between the manifold and screen.

5. A rotary air separator as defined in claim 4 wherein the angular location of the side opening is located in an area of the path of the rotating screen extending from a point prior to the uppermost position of the screen to at least the uppermost position of the screen.

* * * * *